US005647823A

United States Patent [19]

Spence

[11] Patent Number: 5,647,823

[45] Date of Patent: Jul. 15, 1997

[54] THERAPEUTIC APPARATUS FOR EXERCISING THE HUMAN KNEE

[76] Inventor: John R. Spence, 2230 Sunrise Blvd., Fort Myers, Fla. 33907

[21] Appl. No.: 649,019

[22] Filed: May 16, 1996

Related U.S. Application Data

[63] Continuation-in-part of Ser. No. 2,390, Aug. 17, 1995.

[51] Int. Cl.[6] ..... A63B 21/068; A63B 21/002

[52] U.S. Cl. ..... 482/91; 482/95; 482/907

[58] Field of Search ..... 482/91, 95, 130, 482/142, 907; 601/33, 34, 35

[56] References Cited

U.S. PATENT DOCUMENTS

| | | | |
|---|---|---|---|
| 1,144,085 | 6/1915 | Abplanalp | 482/95 |
| 2,335,290 | 11/1943 | Medaris | 601/34 |
| 2,340,666 | 2/1944 | Johanson | 482/91 |
| 2,723,856 | 1/1955 | Thomson | 482/130 |
| 3,117,782 | 1/1964 | Johnston | 482/95 |
| 5,153,959 | 10/1992 | Fitzsimmons | 482/91 |
| 5,261,865 | 11/1993 | Trainor | 482/95 |
| 5,277,680 | 1/1994 | Johnston | 482/907 |
| 5,551,934 | 9/1996 | Binette | 482/130 |

*Primary Examiner*—Lynne A. Reichard
*Attorney, Agent, or Firm*—William E. Noonan

[57] ABSTRACT

An apparatus is disclosed for exercising a person's knee. The apparatus includes a base member that supports a person in a supine position. There are a pair of shoulder braces connected to and extending upwardly from the base member. Each shoulder brace engages a respective shoulder of the supported person. An elongate strap is interconnected to and extends between the shoulder braces. The strap extends across the back of the supported person's leg to hold the upper section of the leg, located generally above the knee, in an upright condition extending upwardly from the base member. The lower section of the leg, located generally below the knee, may be selectively lowered and raised relative to the upper section of the leg to stretch and strengthen the knee.

12 Claims, 3 Drawing Sheets

THERAPEUTIC APPARATUS FOR EXERCISING THE HUMAN KNEE

RELATED APPLICATION

This application is a continuation-in-part of U.S. patent application Ser. No. 60/002,390 filed Aug. 17, 1995.

FIELD OF THE INVENTION

This invention relates to a therapeutic apparatus designed for exercising and rehabilitating the human knee and particularly effective for stretching and strengthening a patient's knee.

BACKGROUND OF THE INVENTION

Persons who have suffered a knee injury or undergone knee surgery often require extensive physical therapy to rehabilitate the damaged muscles and ligaments. To date, a number of devices have been developed to assist in such therapy. Johnston, U.S. Pat. No. 5,253,639, Johnston, U.S. Pat. No. 5,286,242 and Fontaria, U.S. Pat. No. 5,324,245 disclose therapeutic devices designed to stretch the knee joint. However, each of these products requires the use of a fairly complicated pulley mechanism that must be operated by the patient while in either a seated (Johnston '639) or prone (Johnston, '242 and Fontana) position. Each of these devices exhibits a fairly complicated construction. Moreover, it is apt to be unduly strenuous and awkward for patients undergoing therapy to operate these devices. In Johnston '242 and Fontana, not only must the patient lie on his or her stomach, he or she must exert all of the operating force that is required to operate the device.

Mattox et al., U.S. Pat. No. 4,699,376, discloses a hip and joint exercising apparatus wherein the user's leg is positioned in an engaging member that is slidably mounted to an elongated tube. The tube provides frictional resistance to the engaging member. Unfortunately, this apparatus does not permit stretching of the knee. Such stretching is usually required for full knee therapy and rehabilitation.

Harvey, U.S. Pat. No. 5,074,549, discloses a knee stretching device that employs a rectangular frame. This product does not require that the user operate a pulley-type mechanism. However, the patient must use his or her hands and arms to hold the frame in position. As a result, this device could be both overly strenuous and awkward to use.

SUMMARY OF INVENTION

It is therefore an object of the present invention to provide an improved therapeutic apparatus for exercising and rehabilitating the human knee.

It is a further object of this invention to provide a therapeutic apparatus that permits the patient's knee to be effectively stretched and strengthened (i.e. flexed and extended) without any undue exertion or force being required of the patient.

It is a further object of this invention to provide a therapeutic apparatus for strengthening and stretching the knee, which apparatus is lightweight, relatively easy to manufacture and conveniently portable.

It is a further object of this invention to provide a therapeutic apparatus that permits the patient to lie comfortably in a supine position while the knee is flexed and/or extended.

It is a further object of this invention to provide a therapeutic apparatus for exercising the knee, which apparatus may be quickly and conveniently adjusted to fit patients of all sizes.

This invention features an apparatus for exercising a person's knee. The apparatus includes a base member that supports the person in a supine position. There are a pair of shoulder braces connected to and extending upwardly from the base member. Each shoulder brace engages a respective shoulder of the supported person. Means are provided for defining an elongate strap that is interconnected to and extends between the shoulder braces. The strap extends across the back of the supported person's leg to hold an upper section of the leg located generally above the knee in an upright condition, extending upwardly from the base member. A lower section of the leg, located generally below the knee, may be selectively lowered and raised relative to the upper section of the leg to exercise the knee.

In a preferred embodiment, the base includes a generally planar element. The shoulder braces may be unitarily joined to the base and curved to generally conform to the supported person's shoulders. Preferably, a layer of resilient padding is carried by at least one of an upper surface of the base and an inside surface of the shoulder braces. The inside surface of the shoulder braces faces and engages the supported person's shoulders. The base may also carry at least one resilient component on a lower surface of the base.

Means may be provided for releasably attaching the strap to at least one of the shoulder braces. The means for releasably attaching may include a pair of clips formed at respective ends of the strap and a pair of complementary slots formed respectively in the shoulder braces. Each slot is slidably engaged by a respective clip. The straps may include first and second strap components, each being connected to a respective shoulder brace. A releasable mechanism may selectively secure the strap components together. Means may also be provided for adjusting the length of at least one of the strap components to adjust the length of the strap. The strap may carry a pad that engages the back of the held leg. The pad may include means for adjusting the position of the pad along the strap.

BRIEF DESCRIPTION OF THE DRAWINGS

Other objects, features and advantages will occur from the following description of preferred embodiments and the accompanying drawings, in which.

Figure 1:
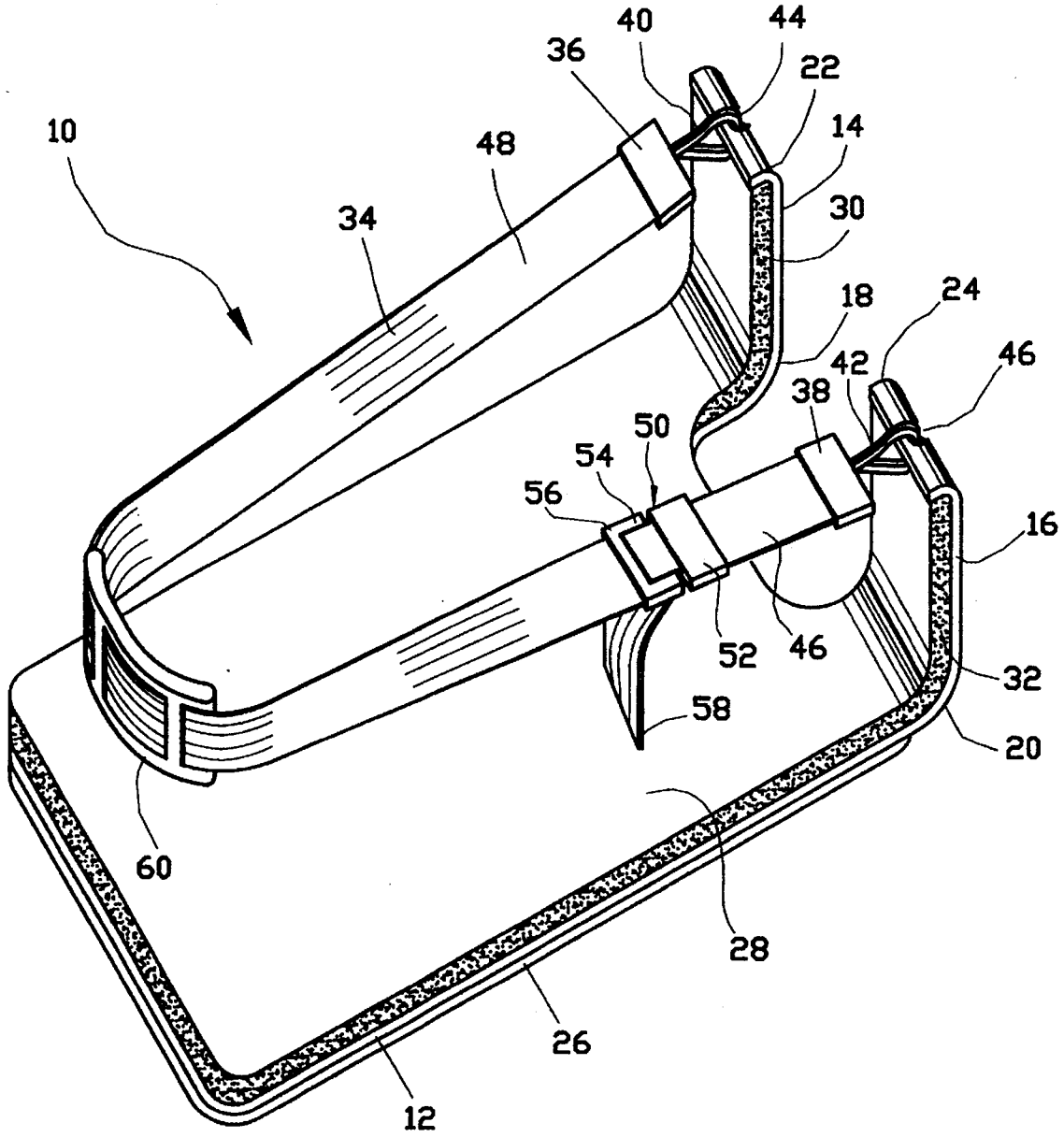
FIG. 1 is a perspective view of the therapeutic knee stretching apparatus of this invention.
Figure 2:
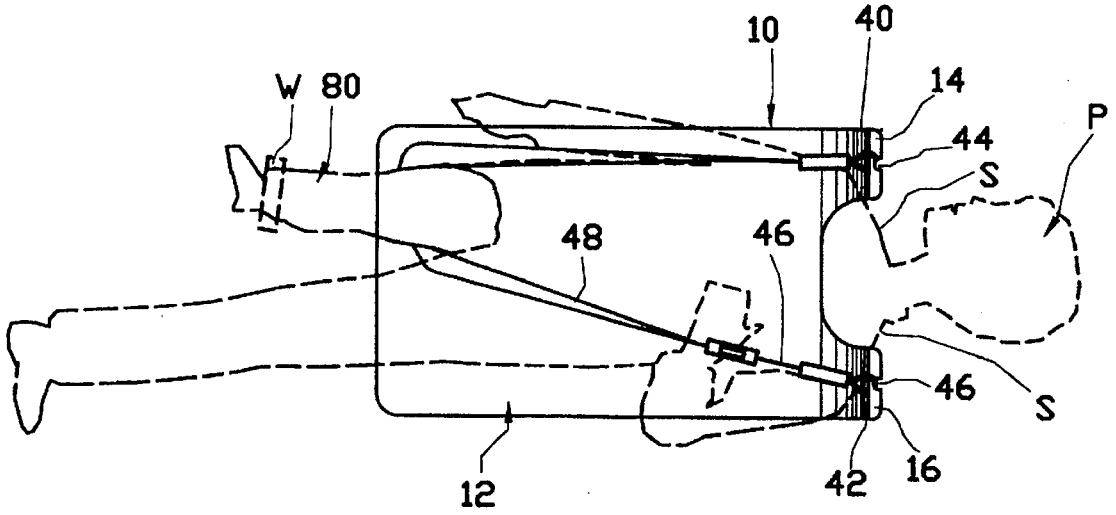
FIG. 2 is a plan view of the therapeutic apparatus with a patient supported thereon and with the patient's leg held in position by the strap to exercise (i.e. stretch or strengthen) the knee joint.
Figure 3:
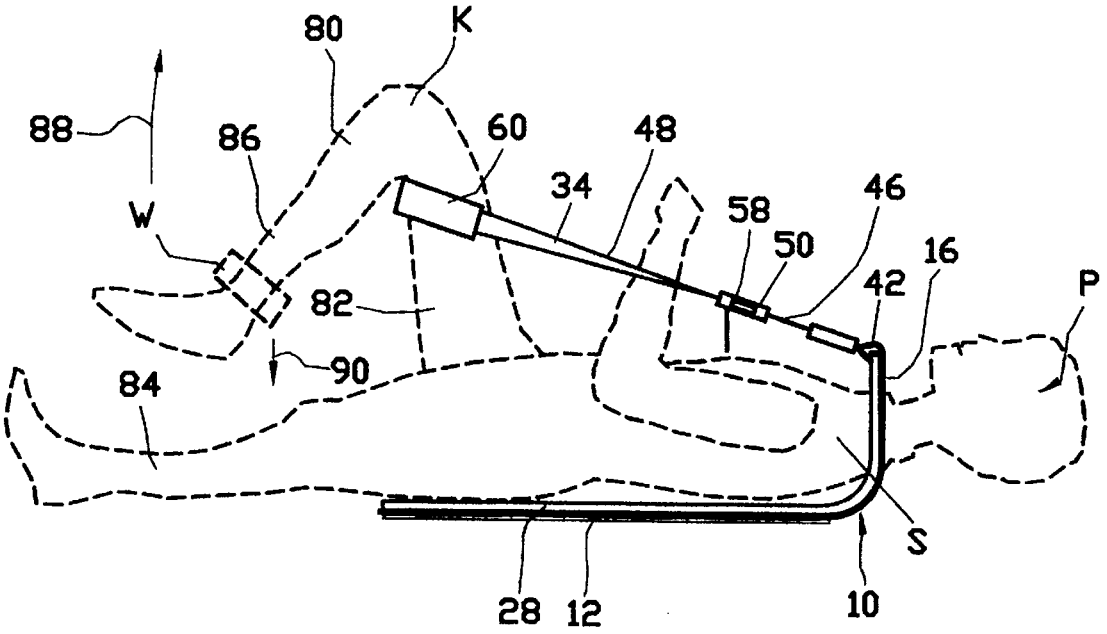
FIG. 3 is a side, elevational view of the therapeutic apparatus with the patient in the position of FIG. 2.

There is shown in FIGS. 1–3 a therapeutic apparatus 10 for stretching (i.e. flexing) and strengthening (i.e. extending) the human knee in accordance with this invention. Apparatus 10 includes a generally planar base member 12. A pair of shoulder braces 14 and 16 are connected to and extend upwardly from base 12 in a generally perpendicular direction. The base element and the shoulder braces comprise a unitary piece formed of molded plastic, aluminum, stainless steel, or some other durable, yet lightweight material. More particularly, the shoulder braces curve upwardly from base element such as at curves 18 and 20, respectively. The upper ends of the shoulder braces 22 and 24, respectively, are turned inwardly in a generally perpendicular direction. In alternative embodiments, the shoulder braces may be constructed separately from the base element and secured thereto by appropriate means.

A resilient support pad 26 is carried by the bottom planar surface of base member 12. This material is typically secured to the lower surface base member 12 by an adhesive. Pad 26 may comprise any type of soft, slip-resistant material such as a foam or other elastomer. This pad allows base member 12 to be placed on a floor, bed, exam therapy table or some other flat surface without scratching the surface or sliding. Pad 26 also provides a cushion so that base member 12 is more comfortable for the user. In alternative embodiments, the cushioning pad 26 may be replaced by a plurality of smaller pads. Such an embodiment is disclosed and described more fully in connection with FIG. 4. Therein, four non-skid support pads 26*a*, 26*b*, 26*c* and 26*d* are carried on the bottom surface of base member 12. These pads may comprise various shapes and sizes. Various numbers of pads may be positioned on the base as desired.

The upper surface of base member 12 carries a layer of typically somewhat thicker resilient padding 28. This padding preferably comprises a closed cell foam or a similar soft, yet supportive material. It is secured to the upper surface of base member 12 by an appropriate adhesive. Pad 28 includes a pair of unitary, upwardly extending portions 30 and 32 that are secured to the inside, concave surfaces of shoulder braces 14 and 16, respectively, Once again, adhesive may be utilized between the shoulder braces and the pad extensions 30 and 32 to secure these components together.

Figure 4:
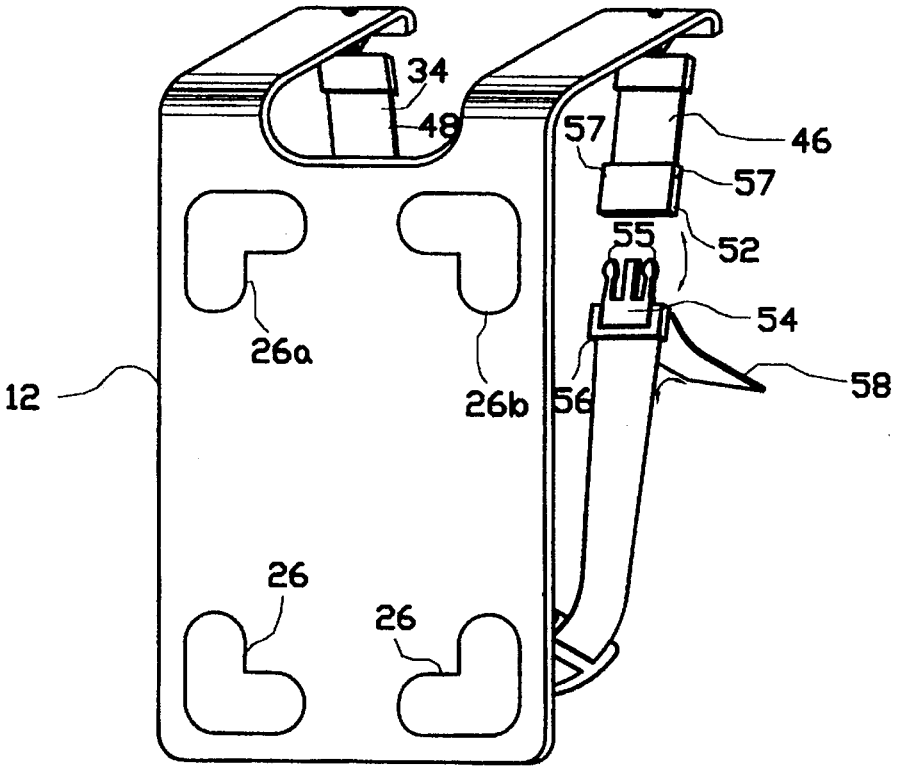
FIG. 4 is a bottom, perspective view of the therapeutic device.

An elongate strap 34 extends between braces 14 and 16. More particularly, a first end plate 36 of strap 34 is releasably attached to brace 14 and a second end plate 38 is similarly attached to brace 16. Strap 34 typically comprises a synthetic or natural fiber construction. A standard snap hook 40 extends from plate 36 and a similar snap hook 42 extends from plate 38. The snap hooks engage complementary slots 44 and 46 formed in inwardly turned ends 22 and 24 of shoulder braces 14 and 16, respectively. In this manner, strap 34 is releasably interconnected to shoulder braces 14 and 16. Strap 34 comprises a relatively short strap component 46 that extends from plate 38 and a relatively long strap component 48 that extends from plate 36. In FIG. 1, strap components 46 and 48 are releasably interconnected through a conventional buckle mechanism 50. More particularly, strap component 46 carries a female part 52 and strap component 48 carries a male part 54 that is releasably engaged with part 52 to secure the strap components together and form the elongate strap 34 between the shoulder braces. Although obscured in FIG. 1, a pair of outer tines 55 of male part 54, shown in FIG. 4, are exposed through recesses 57 in female part 52. Buckle 50 is opened by pressing the resilient plastic tines inwardly and pulling the male and female parts 52 and 54 apart in the manner shown in FIG. 4. This permits the patient to quickly and conveniently position strap 34 about his or her leg so that apparatus 10 can be utilized in the manner described below. Part 52 includes an adjustment loop 56, FIGS. 1 and 4, that slidably receives an end segment 58 of strap component 48. Strap component 48 is slid through the loop 56 in a known manner to adjust the effective length of strap 34.

Figure 5:
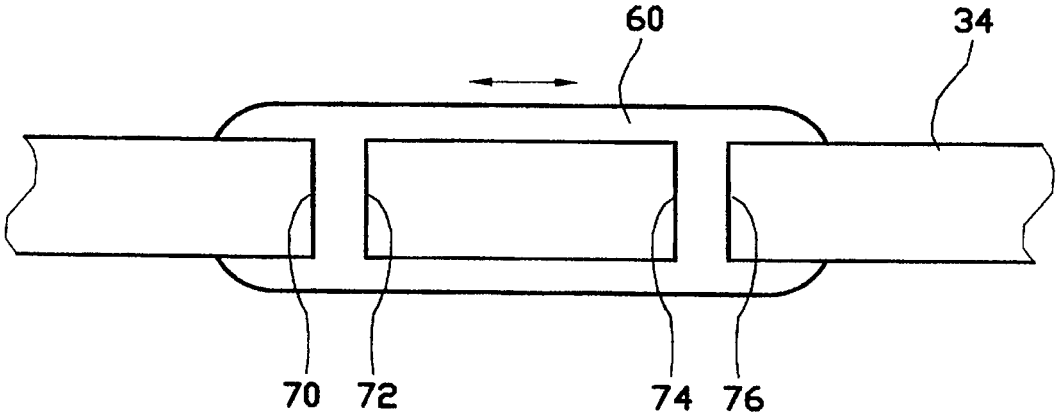
FIG. 5 is an elevational view of an adjustable leg engaging pad that is carried by the strap.

A leg pad 60, shown alone in FIG. 5, is slidably attached to strap 34. Pad 60 comprises a relatively wide pad composed of foam or similar resilient material. The foam may be covered by leather, plastic, or some other outer covering. Pad 60 may be slid along the length of the strap to the desired position for engaging the user's leg. As best shown in FIG. 5, pad 60 includes a first pair of transverse slits 70 and 72 and a second pair of transverse slits 74 and 76 that slidably receive strap 34. As in the prior version, this construction permits the pad 60 to be adjusted along the length of strap 34.

Apparatus 10 is utilized in the manner illustrated in FIGS. 2 and 3. Initially, apparatus 10 is placed on a flat, stable surface, such as the floor or an exam table. The underlying pad 26 holds apparatus 10 securely in place on that flat surface. The user makes sure that strap 34 is securely attached by snap clips 40 and 42 to the shoulder braces 14 and 16. Buckle 50 is opened in the manner previously described and patient P assumes a supine position (i.e. lying on his or her back) on base member 12. More particularly, patient P lies on base member 12 such that the base member is positioned under the user's back. Foam padding 28 provides comfortable, cushioning support for the patient. The patient lies against apparatus 10 such that his or her shoulders S respectively engage shoulder braces 14 and 16. The patient's head and neck extend through and beyond the space between shoulder braces 14 and 16. The generally concave shape of shoulder braces 14 and 16 more or less conforms to the shape of the user's shoulders. Padded extensions 30 and 32 are received within the concave shoulder braces and directly engage the user's shoulders. As a result, a generally conforming, comfortable fit is provided between the patient's shoulders and the shoulder braces.

After patient P has assumed the supine position described above, he or she grasps the long component 48 of strap 34 and extends it across the back of the leg requiring therapy. As best illustrated in FIG. 3, strap 34 is extended across the back of the upper section 82 of the leg (i.e. that section of the leg located above the knee). Strap components 46 and 48 are interconnected at buckle 50 so that upper section 82 of leg 80 is held in an upright condition extending upwardly and generally perpendicularly from base member 12. To achieve this generally perpendicular, upright condition, the length of strap 34 is adjusted by pulling loose end 58 through loop member 55 in the manner previously described. Pad 60 is positioned along strap 34 so that it directly, yet comfortably engages the back of upper leg section 82. As leg 80 is positioned in this manner, the user's other leg 84, remains flat and outstretched from apparatus 10.

When patient P has attained the position shown in FIGS. 2 and 3, he or she is ready to exercise knee K. Apparatus 10 is particularly effective for stretching the knee joint. This is accomplished simply by permitting the lower section 86 of knee 80, which is located generally below knee K, to be lowered in the direction of arrow 90, FIG. 3, relative to upper leg section 82. The weight of the calf and foot cause lower leg section 86 to gradually drop. As a result, knee K is gradually flexed and the knee ligaments are effectively and therapeutically stretched. It is critical for proper therapy that the knee be slowly and gradually stretched, rather than suddenly flexed. Holding upper leg section 82 upright, in the manner shown in FIG. 3, accomplishes this gradual stretching. For certain patients, such stretching may be further assisted by attaching ankle weights W to lower leg section 86.

Apparatus 10 also permits leg 80 to be extended so that knee K can be strengthened in the opposite direction. To perform this exercise, patient P again assumes the position shown in FIGS. 2 and 3. With the upper leg section 82 upright, the lower leg section 86 is raised in the manner illustrated in the direction of arrow 88. This causes knee K to be extended and exercised in the direction opposite to that previously described. This strengthens the knee. Again, ankle weights W may be utilized, when appropriate, to further strengthen the knee.

An important advantage of apparatus 10 is that it permits patient P to effectively stretch and otherwise exercise knee K without undue effort and exertion. Patient P is not required to use his or her arms in any manner to lift or otherwise exercise the leg or knee. Instead, the patient assumes a comfortable supine position throughout the exercise. Apparatus 10 is held effectively in place by the user's buttocks, back and shoulders. When strap 34 is engaged with leg 80, the weight of the leg causes strap 34 to pull shoulder braces 14 and 16 against shoulders S. However, the padded and concave configuration of the shoulder braces allows those components to bear comfortably against the user without causing soreness or exertion.

When therapy is complete, patient P simply releases buckle 50 in the manner previously described and lowers upper leg section 82. The patient then conveniently dismounts apparatus 10 by sitting up and standing. If desired, strap 34 can be removed from shoulder braces 14 and 16 and apparatus 10 can be readily transported or stored for future use.

Apparatus 10 may be manufactured with various dimensions and in assorted sizes, in order to accommodate persons of all heights and frame sizes. The precise dimensions are not a limitation of this invention. The apparatus must simply be able to accommodate a correspondingly sized person in the manner described herein.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. An apparatus for exercising a person's knee, said apparatus comprising:

a base member that supports a person in a supine position;

a pair of shoulder braces connected to and extending upwardly from said base member, each said shoulder brace engaging a respective shoulder of the supported person; and means defining an elongate strap that is interconnected to and extends between said shoulder braces, said strap extending across the back of the supported person's leg to hold the upper section of the leg, located generally above the knee, in an upright condition extending upwardly from said base member, whereby the lower section of the leg, located generally below the knee, may be selectively lowered and raised relative to the upper section of the leg to exercise the knee.

2. The apparatus of claim 1 in which said base includes a generally planar element.

3. The apparatus of claim 1 in which said shoulder braces are unitarily joined to said base.

4. The apparatus of claim 3 in which said shoulder braces are curved to generally conform to the supported person's shoulders.

5. The apparatus of claim 1 in which a layer of resilient padding is carried by at least one of an upper surface of said base and an inside surface of said shoulder braces, said inside surface facing and engaging the supported person's shoulders.

6. The apparatus of claim 1 in which said base carries at least one support pad on a lower surface of said base.

7. The apparatus of claim 1 further including means for releasably attaching said strap to at least one of said shoulder braces.

8. The apparatus of claim 7 in which said means for releasably attaching include a pair of clips formed at respective ends of said strap and a pair of complementary slots formed respectively in said shoulder braces, each slot being releasably engaged by a respective said clip.

9. The apparatus of claim 1 in which said strap includes first and second strap components, each being connected to a respective said shoulder brace, and a releasable mechanism for selectively securing said strap components together.

10. The apparatus of claim 9 further including means for adjusting the length of at least one of said strap components to adjust the length of said strap.

11. The apparatus of claim 1 in which said strap carries a pad that engages the back of the held leg.

12. The apparatus of claim 1 in which said pad includes means for adjusting the position of said pad along said strap.

* * * * *